US007815382B2

(12) United States Patent
Monclus et al.

(10) Patent No.: US 7,815,382 B2
(45) Date of Patent: Oct. 19, 2010

(54) CUTTER ASSEMBLY FOR A PRINTER

(75) Inventors: Antonio Monclus, Castelldefels (ES); Wei Kyan Goh, Singapore (SG)

(73) Assignee: Hewlett-Packard Development Company, L.P., Houston, TX (US)

( * ) Notice: Subject to any disclaimer, the term of this patent is extended or adjusted under 35 U.S.C. 154(b) by 518 days.

(21) Appl. No.: 11/698,069

(22) Filed: Jan. 26, 2007

(65) Prior Publication Data

US 2008/0181711 A1 Jul. 31, 2008

(51) Int. Cl.
*B41J 11/00* (2006.01)
*B26D 1/18* (2006.01)
*B26D 1/24* (2006.01)

(52) U.S. Cl. ..... 400/621; 83/485; 83/487; 83/496; 83/614

(58) Field of Classification Search ..... 400/621; 83/485, 487, 496, 614
See application file for complete search history.

(56) References Cited

U.S. PATENT DOCUMENTS 559,179 A * 4/1896 Koegel ..... 83/497
3,463,040 A * 8/1969 Pouilloux ..... 83/374
3,686,991 A * 8/1972 Fujimoto ..... 83/482
5,042,349 A * 8/1991 Komatsu ..... 83/501
5,503,053 A 4/1996 Onishi et al. ..... 83/488
5,881,623 A 3/1999 Otani et al. ..... 83/455
5,881,624 A 3/1999 Brugue et al. ..... 83/485
5,882,128 A 3/1999 Hinojosa ..... 400/593
5,911,530 A 6/1999 Hinojosa et al. ..... 400/621
6,089,136 A 7/2000 Hinojosa et al. ..... 83/453

* cited by examiner

*Primary Examiner*—Ren Yan
*Assistant Examiner*—Marissa L Ferguson-Samreth

(57) ABSTRACT

A cutter assembly for cutting printed media in a printer comprises a housing arranged for displacement across a media path, in a cutting direction at right angles to a media advance direction in the printer, a first rotary cutting blade carried on said housing such as to be positioned generally on the printed side of the media, and a second rotary cutting blade carried on said housing such as to be positioned generally on the side of the media opposite the printed side, the cutting blades being engageable with each other such as to cut the media between them, and the first rotary cutting blade being arranged upstream of the second rotary cutting blade in the media advance direction.

20 Claims, 9 Drawing Sheets

CUTTER ASSEMBLY FOR A PRINTER

The present invention relates to a cutter assembly for cutting printed media in a printer.

Printers, especially large format printers, are often provided with a cutting device for cutting the printed media downstream of the print zone. Typically, in some large format printers which print on a web of media fed from a roll, the media can be cut transversely to the advance direction after a plot or a number of plots have been printed, in order to separate the newly printed plot or plots from the web.

Some known cutting devices, e.g. the cutter disclosed in U.S. Pat. No. 5,911,530, are mounted on a carriage for reciprocating transversely to the direction of advance of the media in the printer, and comprise two rotating cutting blades which cooperate to cut the media.

With the known arrangements of this kind of cutters there is a risk that the blades themselves, or some parts of the housing where the blades are mounted, contact the printed side of the media, causing scratches. Furthermore, in the case of full-bleed printing, the cut is performed in a printed region of the media, and any contact of the cutter with the printed plot may cause ink smearing or defects in the plot.

The present invention aims at cutting reducing the risk of scratches or ink smearing on the printed side of the media, especially in full-bleed printing.

According to a first aspect, the present invention relates to a cutter assembly for cutting printed media in a printer, comprising a housing arranged for displacement across a media path, in a cutting direction at right angles to a media advance direction in the printer, a first rotary cutting blade carried on said housing such as to be positioned generally on the printed side of the media, and a second rotary cutting blade carried on said housing such as to be positioned generally on the side of the media opposite the printed side, the cutting blades being engageable with each other such as to cut the media between them, wherein the first rotary cutting blade is arranged upstream of the second rotary cutting blade in the media advance direction.

The upstream arrangement of the first cutting blade, which in use is positioned on the printed side of the media, allows to avoid or reduce any potential contact of the blades with the printed side of the media; on one hand, this reduces the risk of ink smearing or other defects when cutting full-bleed plots, and even when used with plots having a margin it reduces the occurrence of scratches on the printed side.

According to a second aspect, the invention relates to a cutter assembly for cutting printed media in a printer, comprising a housing arranged for displacement across a media path, in a cutting direction at right angles to a media advance direction in the printer, a first rotary cutting blade carried on said housing such as to be positioned generally on the printed side of the media, and a second rotary cutting blade carried on said housing such as to be positioned generally on the side of the media opposite the printed side, the cutting blades being engageable with each other such as to cut the media between them, wherein the first rotary cutting blade is arranged upstream of the second rotary cutting blade in the media advance direction, and wherein the first and second cutting blades are both arranged tilted with respect to a plane at right angles to the media advance direction, in opposite directions from each other and around an axis which is at right angles to the media advance direction and to the cutting direction.

In a further aspect, the invention discloses a method for cutting printed media, comprising the steps of providing a first rotary cutting blade generally on the printed side of the printed media and a second rotary cutting blade generally on the underside of the printed media, arranging the first cutting blade upstream with respect to the second cutting blade in a media advance direction, and in engagement with the second cutting blade such that they are able to cut media between them, and displacing said cutting blades across a media path in a cutting direction at right angles to a media advance direction.

Particular embodiments of the present invention will be described in the following, only by way of non-limiting example, with reference to the appended drawings, in which.

Figure 4:
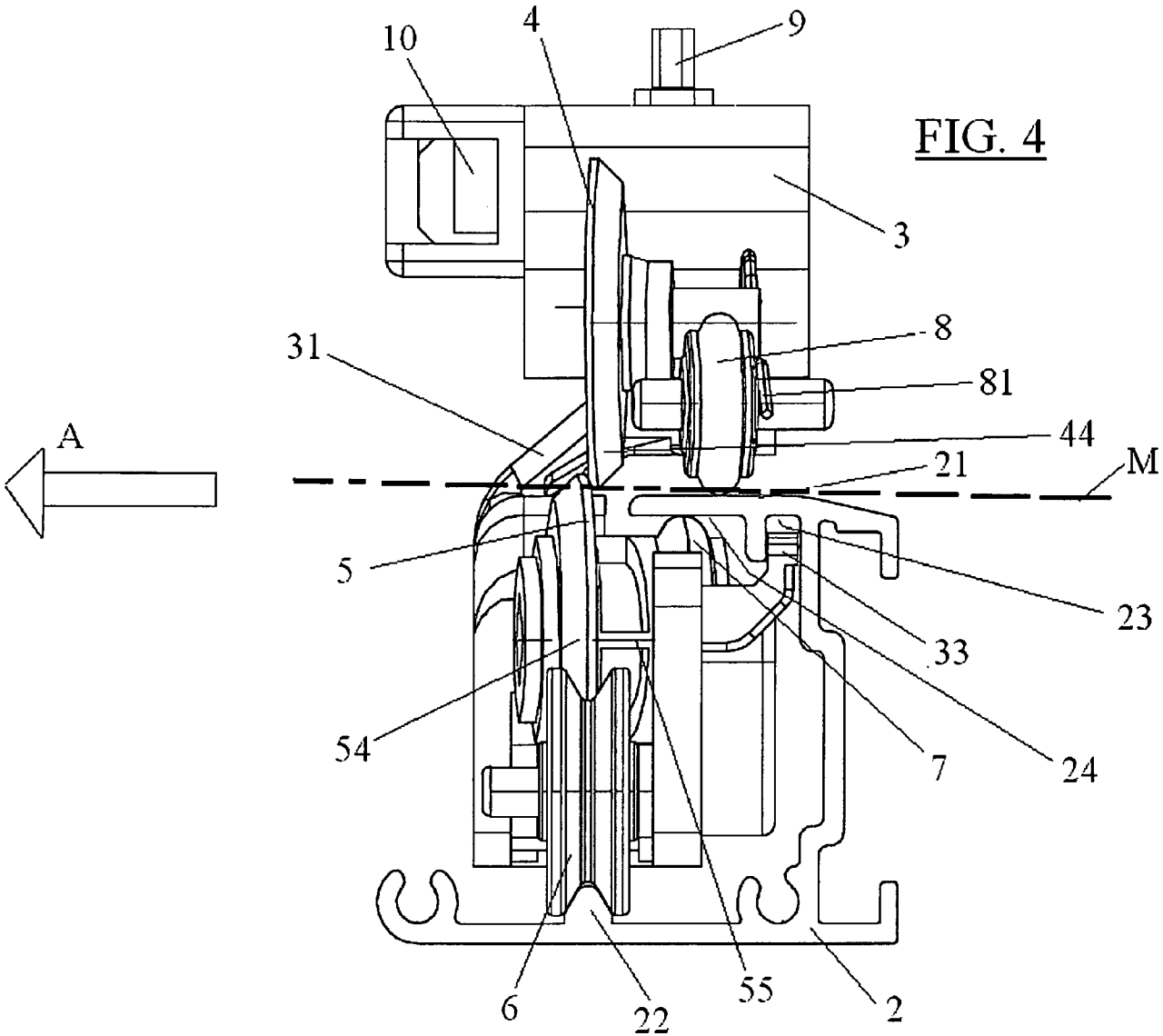
FIG. 4 is a elevation view of the cutter of FIG. 1, as seen from the right side of FIG. 2, with the housing partly cut away.
Figure 6A:
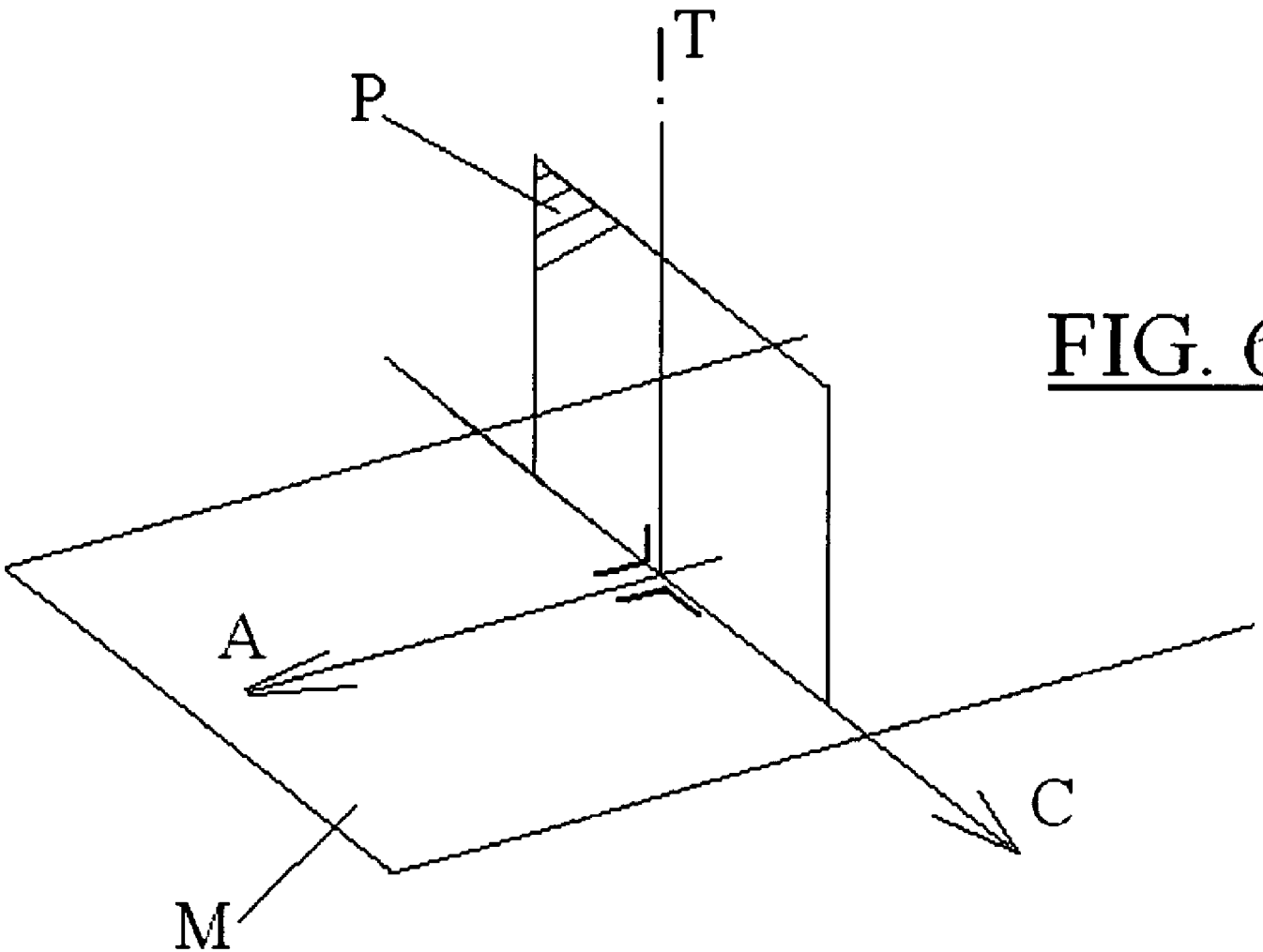
Figure 6B:
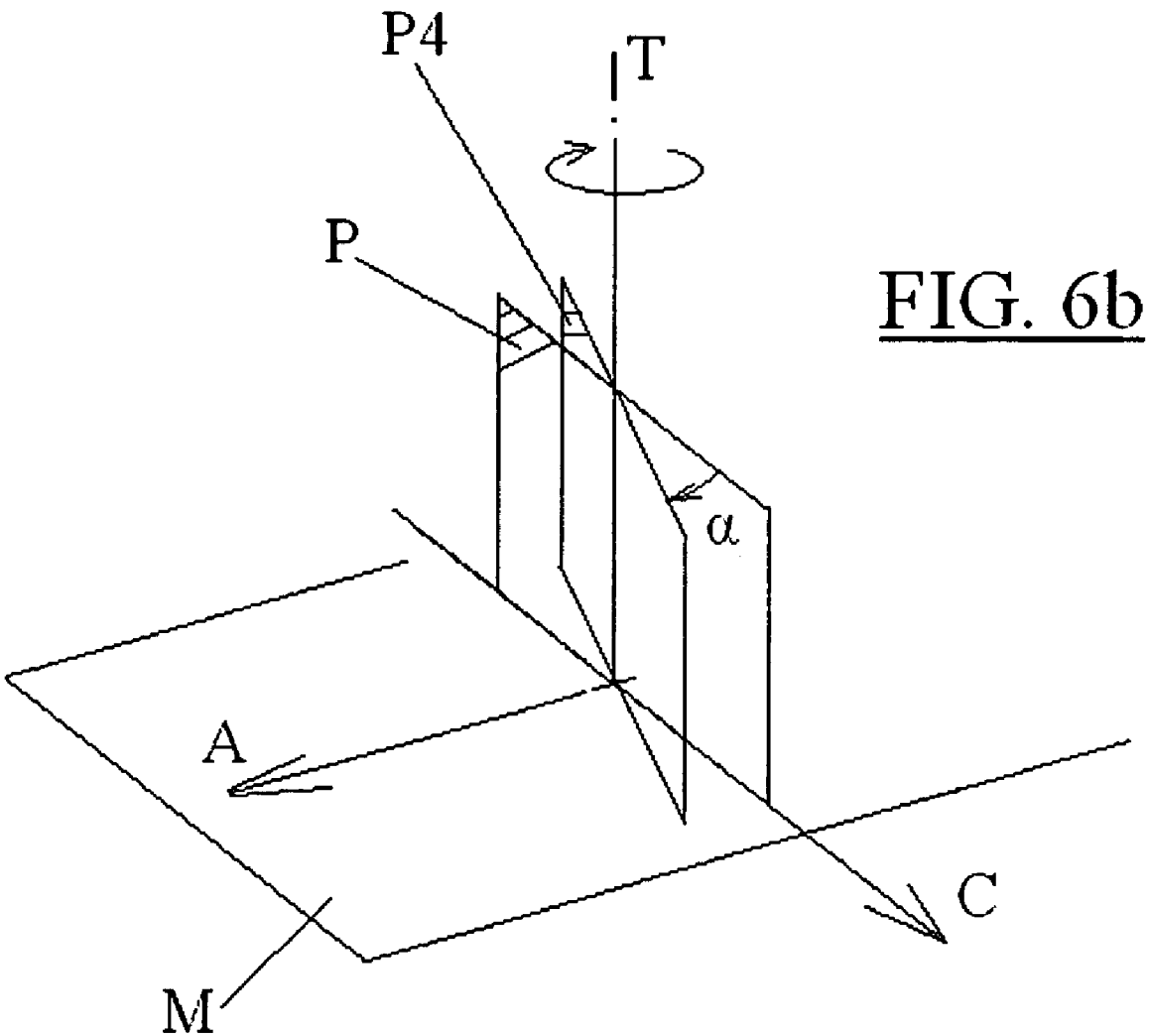
Figure 6C:
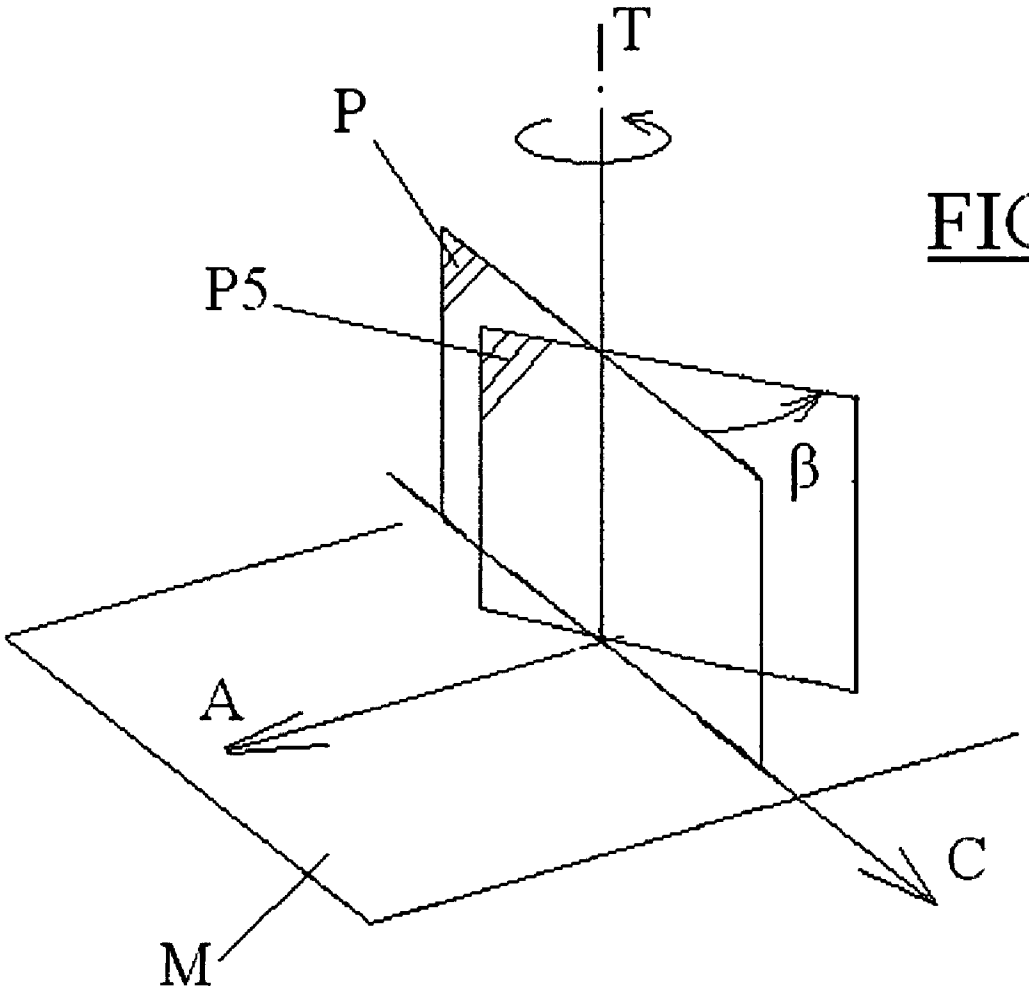
Figure 7:
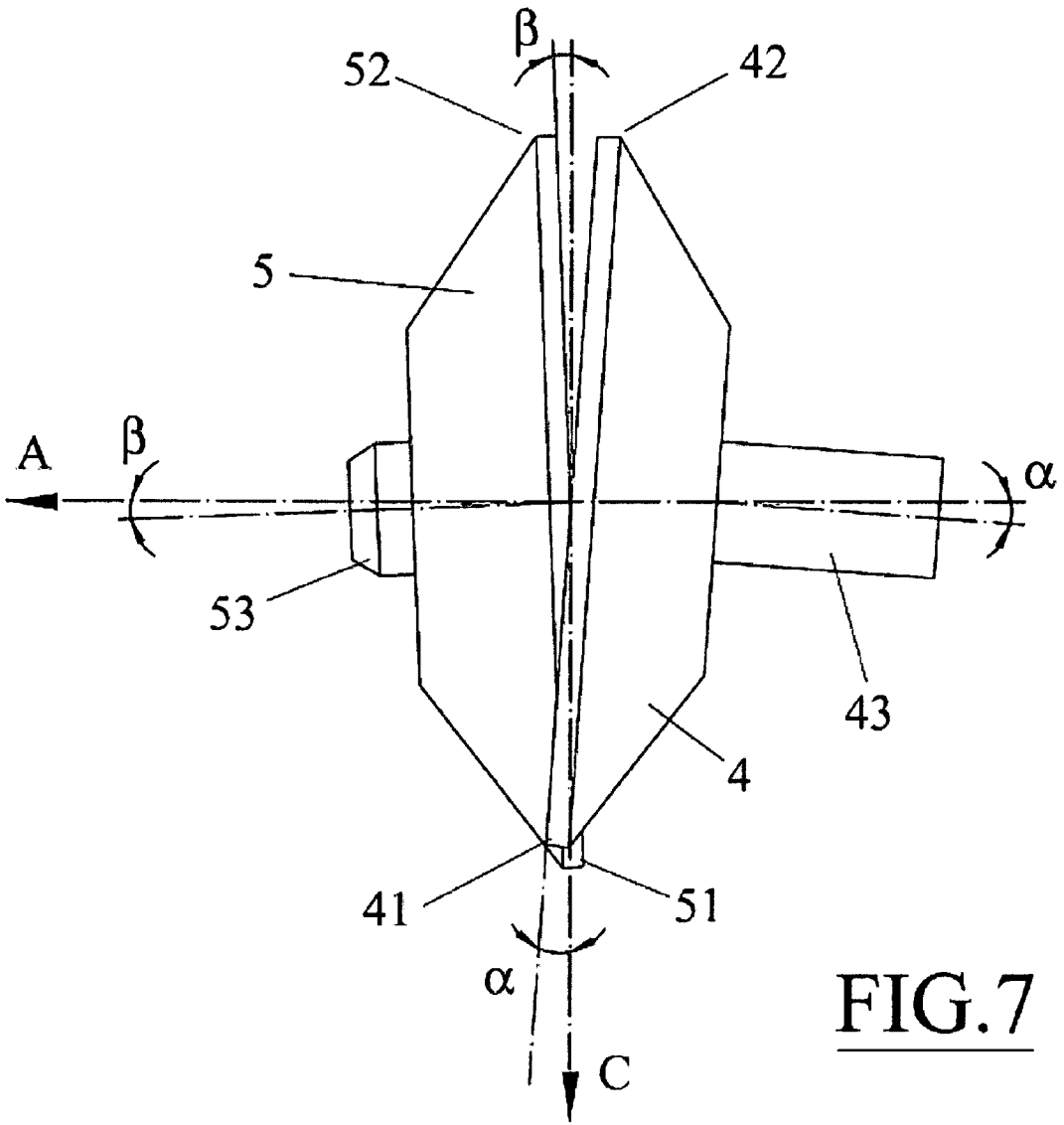

FIGS. 6*a*, 6*b* and 6*c* are schematic drawings illustrating geometrical references related to a cutter according to embodiments of the invention; and FIG. 7 is a partial top view of the cutter of FIG. 4, showing a detail of the arrangement of the cutting blades according to an embodiment of the invention.

Figure 1:
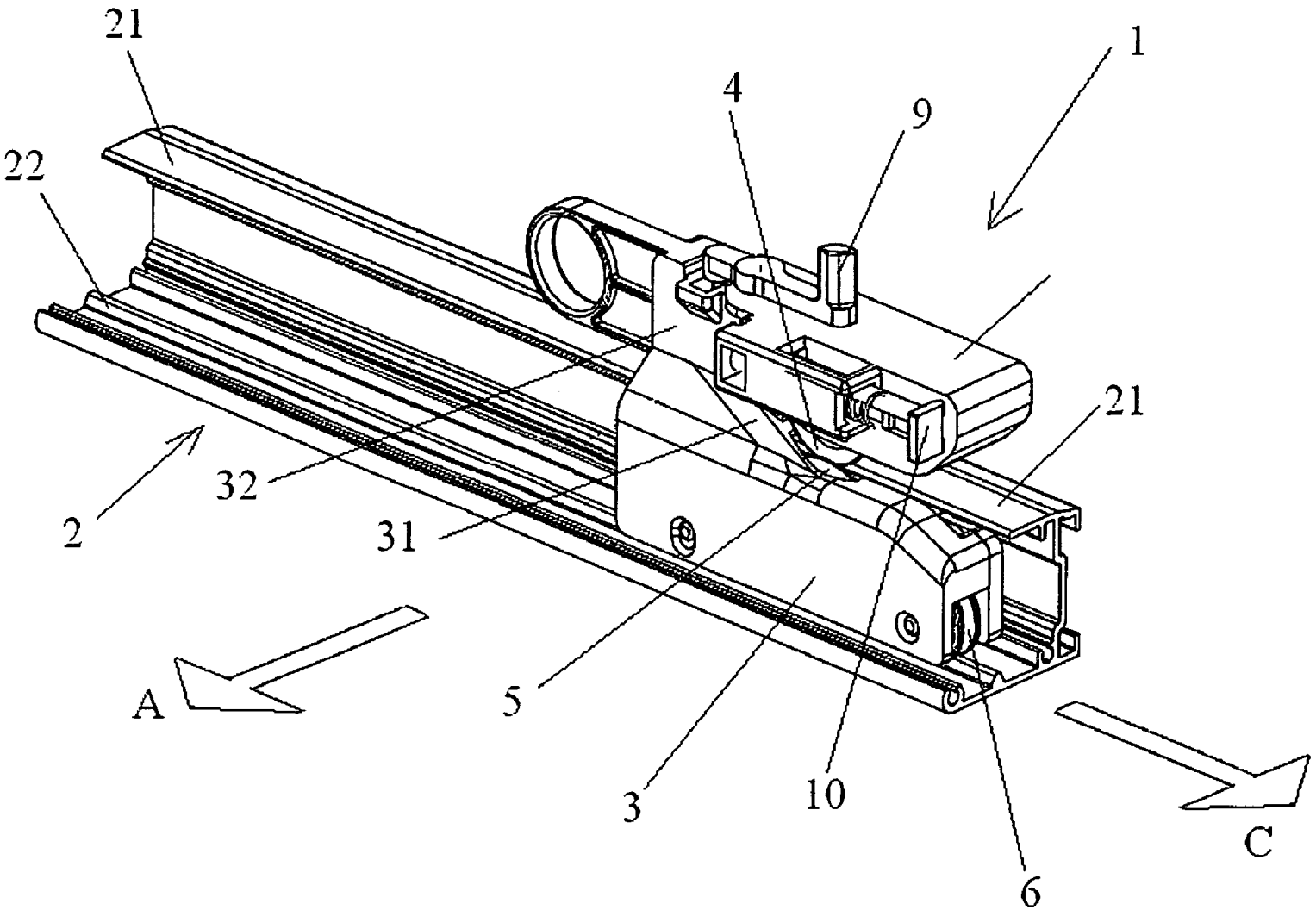
FIG. 1 is a perspective view showing a cutter according to an embodiment of the present invention, engaged in a guide rail.

An embodiment of a cutter assembly 1 according to the invention is shown in perspective FIG. 1; the cutter assembly, or cutter, is arranged for reciprocating movement along a guide rail 2, which is mounted on a large format printer or other printing apparatus downstream of the print zone of the apparatus; the cutter 1 is intended for cutting or separating printed plots from the print media that is still in the print zone, for example a web of media fed to the printer from a roll, or a sheet of media.

For this purpose, as shown in FIG. 1, the guide rail 2 is arranged on the printer across a media advance direction, indicated in the figures by arrow A, spanning the width of the media; thus, while travelling in a cutting direction C along the guide rail 2, the cutter 1 cuts the printed media transversely to the media advance direction A.

The media advance direction A and the cutting direction C are indicated by corresponding arrows in all the appended figures, except when they are orthogonal to the plane of the paper.

Figure 2:
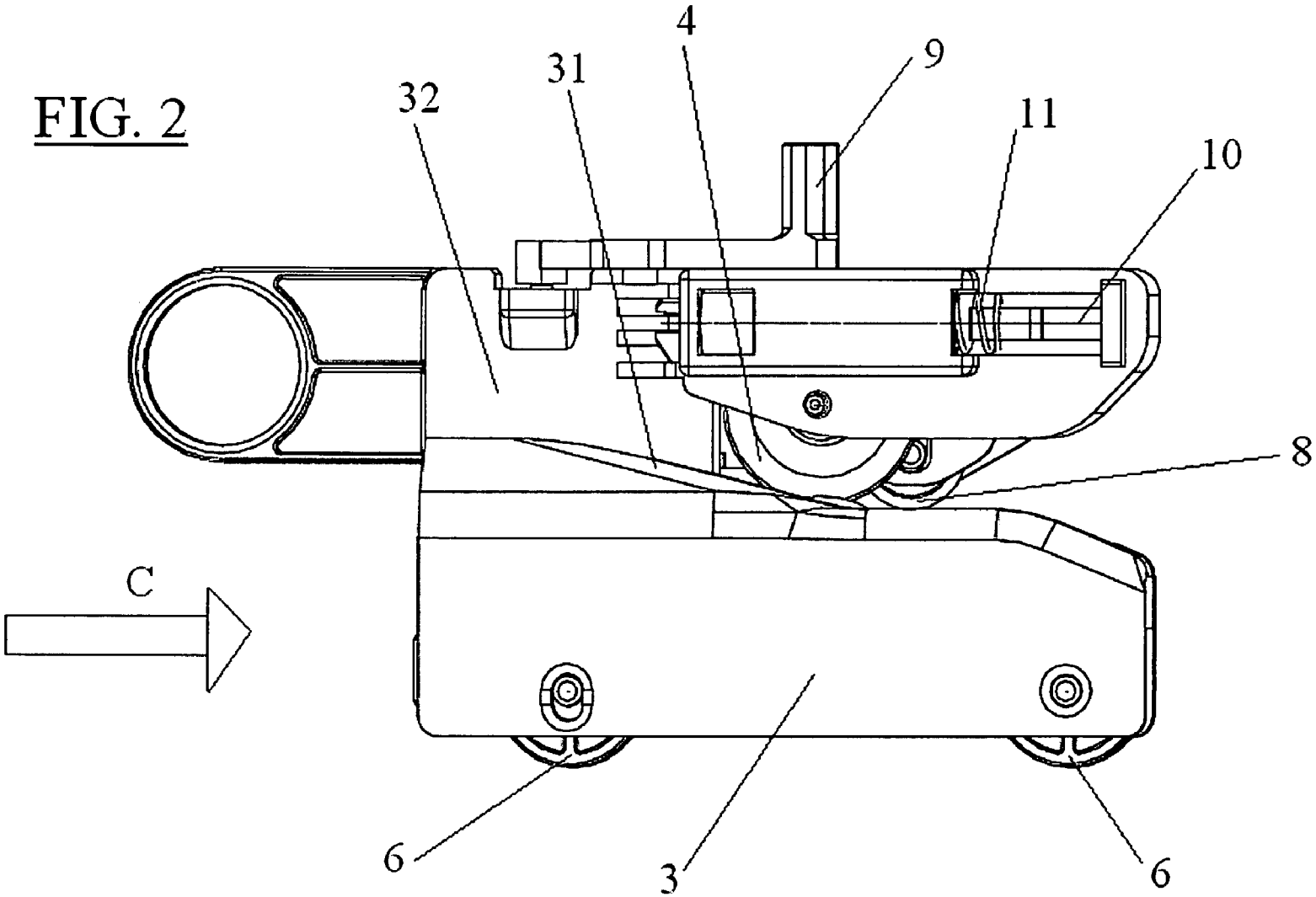
FIGS. 2 and 3 are elevation views of the two opposite sides of the cutter of FIG. 1, with the cutter disengaged from the guide rail.
Figure 3:
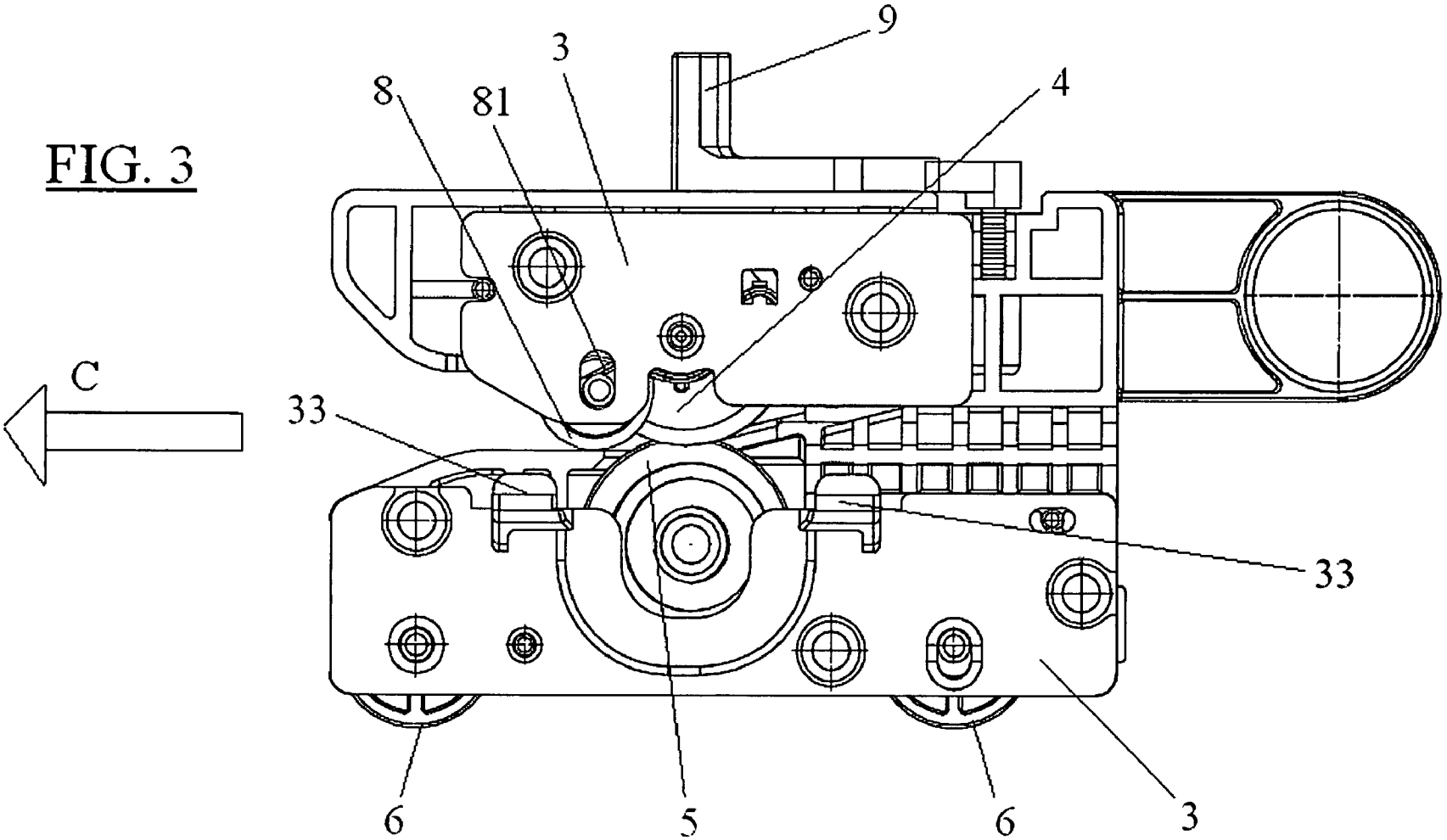

As shown in FIG. 1 and in the elevation views of FIGS. 2, 3 and 4, the cutter 1 has a housing or body 3, in which are encased a first or upper rotary cutting blade 4 and a second or lower rotary cutting blade 5. FIG. 4 also shows in dotted lines the position of the media M across the cutter.

Figure 5:
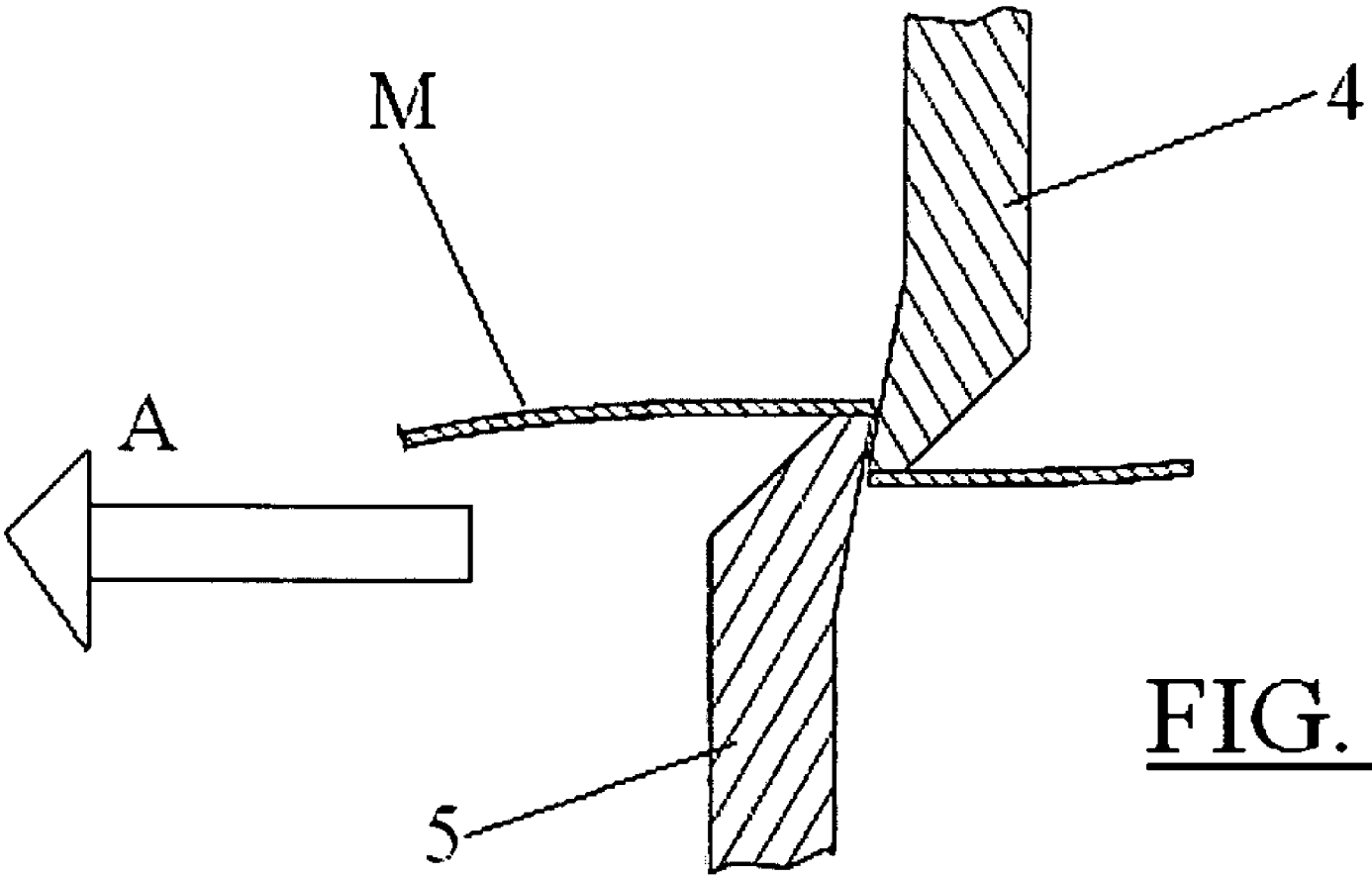
FIG. 5 is a detail of the engagement between the cutting blades of a cutter according to an embodiment of the invention.

As seen in FIGS. 3 and 4, the two blades have a slight overlap and are in contact or engaged with each other at their cutting edges, in order to cooperate for cutting the media. FIG. 5 shows an enlarged and very schematic detail of the engagement between blades 4 and 5, with a portion of media M between them.

It will be understood from the foregoing that, in use, when the cutter is arranged on the guide rail 2 in the printer, the first or upper blade 4 is positioned generally on or over the printed side of the media, white the second or lower blade 5 is positioned generally on the opposite side, i.e. under the media.

The media to be cut rests on the upper surface 21 of the guide rail 2, which thus acts as a media supporting surface in the region of the cutting operation; and as the cutter 1 travels in the cutting direction C along the guide rail 2 the blades 4 and 5 are driven in rotation, as will be explained later on, and cut the media immediately downstream the media supporting surface 21 in the media advance direction A, as best seen in FIG. 4 (in this figure the cutting direction C extends outwards orthogonally to the plane of the paper).

FIGS. 4 and 5 show the relative position of the cutting blades 4 and 5 in the cutter 1: the cutting edges of two blades are positioned in different planes, slightly offset from each other, the first or upper blade 4 being arranged upstream of the second or lower blade 5, in the media advance direction A.

Furthermore, as can be appreciated in the elevation view of FIG. 4, the planes containing the cutting edges of the two blades are not parallel, but tilted in opposite directions.

This tilted arrangement of the blades will be explained in the following with reference to FIGS. 6*a*, 6*b* and 6*c*.

FIG. 6*a* illustrates the geometric references used to define the tilted position of the blades: it shows in perspective a portion of media M which advances in the printer in a media advance direction A, and the guide rail 2 with the cutter 1 in the cutting direction C. In the figure, P indicates a plane at right angles to the media advance direction A, and T indicates an axis at right angles to both the media advance direction and the cutting direction C.

In the common arrangement of a large format inkjet printer, for example, the print media and the directions A and C are on a horizontal plane, such that plane P and axis T would be vertical.

FIG. 6*b* shows the position of the first or upper cutting blade 4: THIS blade 4 does not lie on the plane P, but in a vertical plane P4 that is pivoted an angle α (alpha) around the axis T in the direction shown by the open circle arrow; the first blade 4 therefore is tilted with respect to plane P in such a way that the leading edge 41 of the blade 4 is positioned downstream with respect to the trailing edge 42 of the blade 4, in the media advance direction A (see also FIG. 7).

The angle α (alpha) between the first blade 4 and the plane P, i.e. the angle between the blade and the cutting direction C, may be between 3° and 5°; in one embodiment, the angle is 4°.

FIG. 6*c* similarly shows the position of the second or lower blade 5: the second blade 5 lies in a vertical plane P5 pivoted an angle β (beta) around the axis T in the direction shown by the open circle arrow (opposite to the pivoting direction of the first blade 4) with respect to plane P; the second blade 5 therefore is tilted with respect to said plane P in such a way that, in the media advance direction A, the leading edge of the blade 5 is positioned upstream with respect to the trailing edge of the blade 5.

The angle β (beta) between the second blade 5 and the plane P, i.e. the angle between the blade and the cutting direction C, may be between 1° and 3°; in one embodiment, the angle is 2°.

When reference is made herein to a blade being tilted with respect to a plane, or pivoted about an axis, it is meant that the plane containing the cutting edge of the blade is so tilted or pivoted.

In FIG. 7 the first and second blades 4 and 5 are seen mounted together in the cutter 1, in an enlarged view from the top of FIG. 4: the tilting angles α (alpha) and β (beta) of the blades with respect to the cutting direction C and their relative positioning can be seen. The figure also shows the leading edge 41 and the trailing edge 42 of the upper cutting blade 4, and the leading edge 51 and trailing edge 52 of the lower cutting blade 5.

For providing the blades 4 and 5 with such tilting angles, the shafts 43 and 53 (FIG. 7) that support the blades are arranged in the housing 3 tilted with corresponding angles α (alpha) and β (beta) with respect to the media advance direction A.

It will be noted that in the embodiment shown in the figures and described above the first or upper cutting blade 4 and the second or lower cutting blade 5 are tilted in opposite directions with respect to plane P at right angles to the media advance direction A.

As a consequence of the arrangement of the upper blade 4 upstream of the lower blade 5 in the media advance direction, the portion of printed media that is being cut off from the media that remains engaged in the printer does not contact the cutting blades: indeed, the back side 54 of the lower cutting blade 5 may slide in contact with the media, but since it is arranged on the underside of the media it cannot affect the printed plot, even in the case of full bleed printing when the cut is performed on a region of the media where ink has been deposited. This is particularly helpful with glossy media, where ink takes more time to dry and thus the risk of the cutter blades causing ink smearing if they contact the wet printed side of the plot is higher.

On the contrary, the back side 44 of the upper cutting blade 4, which may slide in contact with the printed side of the media, contacts a portion of the media that is either unprinted (in normal printing with margins) or will later be cut and discarded (in the case of full bleed printing), and thus in practice has no effect on the printed plot.

The arrangement of the blades 4 and 5 tilted with respect to a plane P at right angles to the media advance direction A assists in obtaining a smooth and fine cut quality; the tilting angle of the lower blade assists in diverting or deflecting the trailing edge of the cut media upwards, avoiding or reducing contact with any potential contact surfaces, such as the body or housing 3 of the cutter, and also in improving the cut quality.

In this respect, the body or housing 3 of the cutter assembly is shaped so as to avoid contact with the trailing edge of the cut media: as shown in FIGS. 1, 2 and 4, the side of the housing 3 that faces downstream in the media advance direction is provided with a sloped surface 31 that leads the trailing edge of the cut media upwards, away from the lower blade 5 and the guide rail 2, to avoid as much as possible the risk of contact with any surface of the cutter. Indeed, in FIG. 1 it can also be seen that in the region immediately following the sloped surface, towards which the trailing edge of the cut media is diverted, the housing 3 has a vertical wall 32 and no projecting surfaces with which the printed side of the media may contact; other parts of the cutter housing are further up, out of reach for the media.

Further features of the cutter assembly 1 will be explained in the following, also with reference to FIGS. 1 to 4.

The cutter 1 is mounted and guided in the guide rail 2 by means of two wheels 6, shaped to fit with a ridge 22 formed by the guide rail 2, and two sliders 33 of the body or housing 3, which fit and slide in a corresponding groove 23 formed by the guide rail 2 (FIG. 4).

One of the wheels 6 is mounted with some play in the housing and biased by a spring (not shown), such as to avoid that the cutter 1 may travel loosely in the guide rail 2.

The rotation of the cutting blades 4 and 5 as the cutter 1 travels along the guide rail 2 is driven by a rubber wheel 7, partly visible in FIG. 4, which rotates during the travel of the cutter 1 along the guide rail 2 by virtue of its contact with a track 24 formed on the guide rail 2. The track 24 can be a simple flat surface of the guide rail 2.

The driving wheel 7 is mounted coaxial to the second or lower cutting blade 5 and is locked or otherwise associated in rotation with this blade, such that the driving wheel 7 drives the blade 5 in rotation when the cutter 1 travels along the guide rail 2. In the embodiment shown in FIG. 4, the second blade 5 and the driving wheel 7 are both arranged on a plastic cage 55 with the function of a common shaft.

The first or upper blade 4 is driven in rotation in opposite direction by its engagement with the second or lower blade 5.

The cutter assembly also comprises a plastic press wheel 8, mounted in the housing 3 with a degree of vertical play and biased by a spring 81 (FIG. 3); the press wheel 8 is intended to engage the upper side of the media and press the media downwards against the upper supporting surface 21 of the guide rail 2, immediately upstream of the cutting blades, for keeping the media flat on the supporting surface and thus facilitate a straight cut and avoid jamming. The press wheel 8 contacts the printing side on the media, but on the portion of the media that has not been printed yet.

The press wheel 8 is arranged tilted about a vertical axis, in order to improve the straightness of the cutting line by introducing a horizontal force component that tends to push the media in a direction towards the cutting blades.

The press wheel may be tilted an angle of between 2.5 and 4.5 degrees, such as 3.5 degrees, in the same direction of tilting of the lower blade axis.

A media cutting operation will be briefly described in the following, mainly with reference to FIG. 1 and in relation with a large format inkjet printer; such a printer is usually provided with a printhead carriage (not shown) that reciprocates in a direction parallel to the cutting direction C in order to deposit ink on the media in successive print swaths.

The cutter 1 is usually maintained stationary in a starting position at one side of the media path, at the left hand end of the guide rail 2 in the embodiment of FIG. 1.

When the printhead carriage has finished printing a plot, and then the media has been advanced such as to be suitably arranged on the guide rail 2 and ready to be cut, the printhead carriage travels to the position of the cutter at the left hand side of FIG. 1, and a hook 9 provided at the top of the cutter is engaged by a corresponding catch on the carriage. The printhead carriage then travels towards the right hand side of FIG. 1, entraining the cutter 1 along the guide rail 2 and causing the media to be cut.

At the end of its travel, the carriage pushes the cutter 1 again towards the left in FIG. 1 in a return travel; however, in this case this is done by contact of the carriage with a plunger 10 attached to the cutter housing and biased outwards by a spring 11; at the end of the return travel, the carriage pushes the piston 10 against the spring 11, and this allows the carriage to advance a small additional length with respect to the cutter 1, and this small additional length allows the hook 9 to be disengaged from the carriage catch. The cutter is therefore back in the starting condition, ready for the next cut.

Of course the cutter may be moved along the guide rail by means of a different kind of driving device, in place of the printhead carriage.

A method for cutting printed media according to an embodiment of the invention comprises providing an upper and a lower rotary cutting blades 4 and 5, respectively over and under the media M to be cut, arranging the upper cutting blade 4 upstream with respect to the lower cutting blade 5 in the media advance direction A, and displacing the cutting blades across the media path in the cutting direction C, at right angles to the media advance direction.

The invention claimed is:

1. A cutter assembly for cutting printed media in a printer, comprising:

a housing arranged for displacement across a media path, in a cutting direction at right angles to a media advance direction at a location of the cutter assembly in the printer, a first rotary cutting blade carried on said housing such as to be positioned generally on a printed side of the media, and a second rotary cutting blade carried on said housing such as to be positioned generally on a side of the media opposite the printed side, the cutting blades being engageable with each other such as to cut the media between them, wherein the first rotary cutting blade is arranged upstream of the second rotary cutting blade in the media advance direction at the location of the cutter assembly in the printer.

2. A cutter assembly as claimed in claim 1, wherein the first blade is tilted with respect to a plane at right angles to the media advance direction, around an axis which is at right angles to the media advance direction and to the cutting direction.

3. A cutter assembly as claimed in claim 2, wherein the first blade is tilted such that a forward edge of the first blade during the cutting operation is positioned downstream with respect to a rearward edge of the first blade, in the media advance direction.

4. A cutter assembly as claimed in claim 3, wherein the first blade is tilted an angle between 3° and 5° with respect to said plane at right angles to the media advance direction.

5. A cutter assembly as claimed in claim 1, wherein the second blade is tilted with respect to a plane at right angles to the media advance direction, around an axis which is at right angles to the media advance direction and to the cutting direction.

6. A cutter assembly as claimed in claim 5, wherein the second blade is tilted such that a forward edge of the second blade during the cutting operation is positioned upstream with respect to a rearward edge of the second blade, in the media advance direction.

7. A cutter assembly as claimed in claim 6, wherein the second blade is tilted an angle between 1° and 3° with respect to said plane at right angles to the media advance direction.

8. A cutter assembly as claimed in claim 1, wherein the first blade and the second blade are tilted with respect to a plane at right angles to the media advance direction, around an axis which is at right angles to the media advance direction and to the cutting direction.

9. A cutter assembly as claimed in claim 8, wherein the first blade and the second blade are tilted in opposite directions with respect to said plane at right angles to the media advance direction.

10. A cutter assembly as claimed in claim 9, wherein the first blade is tilted such that a forward edge of the first blade during the cutting operation is positioned downstream with respect to a rearward edge of the first blade, in the media advance direction, and the second blade is tilted such that a forward edge of the second blade during the cutting operation is positioned upstream with respect to a rearward edge of the second blade, in the media advance direction.

11. A cutter assembly as claimed in claim 10, wherein the first blade is tilted an angle between 3° and 5° with respect to said plane at right angles to the media advance direction, and the second blade is tilted an angle between 1° and 3° with respect to said plane at right angles to the media advance direction.

12. A cutter assembly as claimed in claim 1, wherein at least a portion of a surface of the housing which, in use, is arranged downstream in the media advance direction has a shape suitable for diverting a trailing edge of the cut media away from the second blade.

13. A cutter assembly as claimed in claim 12, wherein said shape comprises a sloped surface extending between a cutting region where the first and second blades cooperate for cutting the media and a region upstream said cutting region in the cutting direction, whereby, in use, the trailing edge of the cut media is guided on said sloped surface and diverted away from the second blade.

14. A cutter assembly as claimed in claim 1, further comprising a driving wheel, adapted to be rotated in use as a consequence of displacement of the housing across the media path in the cutting direction, and associated in rotation with at least one of the first and second blades.

15. A cutter assembly as claimed in claim 14, wherein said driving wheel is coaxial to the second blade and associated in rotation with said second blade, whereby, in use, the second blade is driven in rotation by the driving wheel during displacement of the housing.

16. A cutter assembly as claimed in claim 15, wherein, in use, the first blade is driven in rotation by contact with the second blade.

17. A cutter assembly as claimed in claim 14, wherein said driving wheel is arranged to contact, in use, a corresponding track provided on the printer along the cutting direction, whereby, in use, the displacement of the housing with respect to the printer causes displacement of the driving wheel in contact with said track and consequent rotation of the driving wheel.

18. A cutter assembly for cutting printed media in a printer, comprising:

a housing arranged for displacement across a media path, in a cutting direction at right angles to a media advance direction at a location of the cutter assembly in the printer, a first rotary cutting blade carried on said housing such as to be positioned generally on a printed side of the media, and a second rotary cutting blade carried on said housing such as to be positioned generally on a side of the media opposite the printed side, the cutting blades being engageable with each other such as to cut the media between them, wherein the first rotary cutting blade is arranged upstream of the second rotary cutting blade in the media advance direction at the location of the cutter assembly in the printer, and wherein the first and second cutting blades are both arranged tilted with respect to a plane at right angles to the media advance direction, in opposite directions from each other and around an axis which is at right angles to the media advance direction and to the cutting direction.

19. A printer comprising a cutter assembly for cutting printed media as claimed in claim 1.

20. A method for cutting printed media, comprising:

providing a first rotary cutting blade generally on a printed side of the printed media and a second rotary cutting blade generally on an opposite side of the printed media, arranging the first cutting blade upstream with respect to the second cutting blade in a media advance direction at a location of the cutting blades, and in engagement with the second cutting blade such that the cutting blades are able to cut media between them, and displacing said cutting blades across a media path in a cutting direction at right angles to the media advance direction.

* * * * *